US008166877B2

(12) United States Patent
Jung

(10) Patent No.: US 8,166,877 B2
(45) Date of Patent: May 1, 2012

(54) PRINTING PRESS HAVING A DRYER DEVICE FOR VARNISHED SHEETS

(75) Inventor: Jochen Jung, Sandhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 91 days.

(21) Appl. No.: 12/505,703

(22) Filed: Jul. 20, 2009

(65) Prior Publication Data

US 2009/0277352 A1 Nov. 12, 2009

Related U.S. Application Data

(62) Division of application No. 11/954,150, filed on Dec. 11, 2007, now abandoned.

(30) Foreign Application Priority Data

Dec. 11, 2006 (DE) ..... 10 2006 058 238

(51) Int. Cl.
*B41L 35/14* (2006.01)

(52) U.S. Cl. ..... 101/424.1; 101/488

(58) Field of Classification Search ..... 101/424.1
See application file for complete search history.

(56) References Cited

U.S. PATENT DOCUMENTS

| | | | | |
|---|---|---|---|---|
| 2,329,152 | A * | 9/1943 | Breyer | 101/220 |
| 4,617,864 | A * | 10/1986 | Niedermaier et al. | 101/219 |
| 5,092,241 | A * | 3/1992 | Feser et al. | 101/153 |
| 6,143,074 | A * | 11/2000 | Komori | 118/209 |
| 6,223,799 | B1 * | 5/2001 | Johnstone | 156/542 |
| 6,293,196 | B1 * | 9/2001 | DeMoore et al. | 101/424.1 |
| 6,413,360 | B1 * | 7/2002 | Morita et al. | 156/379.8 |
| 6,722,278 | B2 * | 4/2004 | Tomita | 101/424.1 |
| 6,739,253 | B2 | 5/2004 | Schaum | |
| 6,829,996 | B2 * | 12/2004 | Jung et al. | 101/491 |
| 6,838,788 | B2 | 1/2005 | Park et al. | |
| 6,868,788 | B2 * | 3/2005 | Henning et al. | 101/487 |
| 6,983,696 | B2 * | 1/2006 | Koch et al. | 101/487 |
| 7,017,493 | B2 | 3/2006 | Jung et al. | |
| 7,044,059 | B2 | 5/2006 | Koch et al. | |
| 7,318,378 | B2 * | 1/2008 | Bitterich et al. | 101/147 |
| 2002/0178954 | A1 * | 12/2002 | Hayashi et al. | 101/487 |
| 2004/0144270 | A1 * | 7/2004 | Dauner | 101/217 |
| 2006/0156941 | A1 * | 7/2006 | Mori et al. | 101/467 |

FOREIGN PATENT DOCUMENTS

| | | | |
|---|---|---|---|
| CH | 274259 | | 3/1951 |
| DE | 10020648 | A1 | 10/2001 |
| DE | 10305594 | A1 | 9/2003 |
| DE | 102004022595 | A1 | 2/2005 |
| DE | 102005011696 | A1 | 11/2005 |
| DE | 102005042956 | A1 | 4/2006 |
| EP | 1287204 | B1 | 3/2003 |
| EP | 1502738 | A1 | 2/2005 |
| WO | 0168223 | A1 | 12/2007 |

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A printing press and a method of drying printed or varnished sheets in a printing press include heating printed and/or varnished sheets, before the sheets enter a dryer, to a temperature higher than the ambient temperature, through the use of a heatable impression cylinder in the last printing and/or varnishing unit upstream of the thermal dryer device.

16 Claims, 4 Drawing Sheets

PRINTING PRESS HAVING A DRYER DEVICE FOR VARNISHED SHEETS

CROSS-REFERENCE TO RELATED APPLICATION

This application is a division of U.S. application Ser. No. 11/954,150 filed Dec. 11, 2007; the application also claims the priority, under 35 U.S.C. §119, of German Patent Application DE 10 2006 058 238.1, filed Dec. 11, 2006; the prior applications are herewith incorporated by reference in their entirety.

BACKGROUND OF THE INVENTION

Field of the Invention

The invention relates to a printing press including a plurality of printing or varnishing units and a dryer device for drying printed or varnished sheets.

Multi-color printing presses with additional varnishing unit(s) usually include a dryer device in which the layer of ink or varnish that has been applied is dried before the sheets are deposited on a sheet stack. It is not easy to dry the sheet sufficiently in the short time it remains in the dryer device, in particular if aqueous dispersion varnish is used. At the high machine speeds of 16,000 or 18,000 sheets per hour that are common today, the sheets frequently stay in the dryer for less than a second. One attempt to counteract this has been to manufacture machines with what is known as an "extended delivery" and to provide a plurality of dryer modules following each other in the delivery of the printing press, typically 3 to 4 dryer modules. Moreover, two or more drying towers are frequently used instead of just one drying tower for additional drying of the sheets between two varnishing units. Another attempt has been to increase the drying performance by increasing the temperature and/or the hot air stream. For instance, in machines of the 70/100 format, it is not uncommon today to use a dryer device with a wattage of more than 100 kW in the delivery and even 125 kW in the drying towers between the varnishing units and to extend the dryer section in the delivery to 4 m.

However, increasing the wattage of the dryer devices does not make sense in economic terms because a large proportion of the energy is not used to evaporate the solvents from the ink or the water from the layer of varnish, but is lost as waste heat. On one hand, this is due to the fact that the degasification or evaporation process does not start at full strength when the sheet enters the dryer because a large proportion of the energy is required initially to heat up the sheet of paper itself. On the other hand, the measure of extending the delivery and adding dryer units considerably increases the installation space required for such a printing press. Apart from the fact that such a measure becomes impossible in some cases for reasons of space limitations, an additional dryer unit or an extended delivery means additional costs that increase the price of the printing press.

It is known from International Patent Application No. WO 01/68223 A1, corresponding to U.S. Pat. No. 6,868,788, to use the waste heat of the printing press for pre-heating the air of a thermal dryer. However, that measure is insufficient to solve the problems indicated above, i.e. the high energy consumption of the dryer itself and the long dryer sections.

Another option is the introduction of what are known as "interdeck dryers" into every printing unit in question to dry the ink or varnish directly at that location. Apart from the fact that such a measure is highly complex, such interdeck dryers have their drawbacks inasmuch as the sheets are heated up during an ongoing printing operation. That may have a negative effect on the quality of the printed image because the conditions in the press during a printing operation are desired to be as uniform as possible. As a consequence, additional steps must be taken, for example to compensate for an uneven heating up of an impression cylinder equipped with an interdeck dryer, as described in German Published, Non-Prosecuted Patent Application DE 10 2005 022 595 A1. Alternatively, cooled blown air is introduced into the path of sheet travel to cool down the sheet in the subsequent printing unit to the desired temperature for the printing operation, as described in European Patent Application EP 1 502 738 A1, corresponding to U.S. Pat. No. 7,044,059.

For those reasons, interdeck dryers are usually not thermal dryers, but mainly UV dryers used in connection with printing inks that harden under the influence of ultraviolet light.

Furthermore, German Published, Non-Prosecuted Patent Application DE 103 05 594 A1 discloses an interdeck dryer wherein the impression cylinder of a printing or varnishing unit is heated up.

European Patent EP 1 287 204 B1, corresponding to U.S. Pat. No. 7,017,493, describes heated smoothing rollers for treating the printed or varnished sheet surface and for heating up the printed sheet. However, that document also describes additional cooling rollers for cooling down the printing material or printed sheet after the smoothing operation. The problems of the dryer that have been described above are not dealt with in that document.

BRIEF SUMMARY OF THE INVENTION

It is accordingly an object of the invention to provide a printing press and a method of drying printed or varnished sheets in a printing press, which overcome the hereinaforementioned disadvantages of the heretofore-known devices and methods of this general type, which improve the drying of the sheets in a sheet-fed printing press and which make the drying operation more efficient.

With the foregoing and other objects in view there is provided, in accordance with the invention, a method of drying printed or varnished sheets in a sheet-fed printing press. The method comprises providing a plurality of printing and/or varnishing units and a dryer device, and heating the sheets to a temperature higher than the ambient temperature before the sheets enter the dryer device.

This ensures that the degasification or evaporation process starts as soon as the sheet enters the dryer device and is subjected to hot air and/or infrared radiation. Due to this measure, the length of the dryer section can be shortened considerably and the energy required by the dryer device can be reduced, an aspect that is of particular importance in terms of dryers that use infrared radiation because they have a relatively low efficiency factor of about 25% anyway.

In accordance with another mode of the invention, it is expedient for the sheet to be heated up to a temperature above the temperature of the printing units in the printing press, for example to a temperature in the range between 25° C. and 50° C. (approximately between 77° F. and 122° F.), preferably between 32° C. and 45° C. (approximately between 90° F. and 113° F.), because this is the temperature range to which the paper that passes through a hot-air dryer or a radiation dryer is approximately heated up in an asymptotic way in the sense of what is known as a "persistence temperature" until the sheet leaves the dryer. The persistence temperature is the temperature that the sheet assumes while the ink is degasified or the wetness is evaporated from the layer of varnish. In the process, a balance is reached between the heat that is being supplied by the hot air or infrared radiation and the heat that is being output due to the evaporation of the wetness and solvents.

In accordance with a further mode of the invention, it is expedient for the sheets to be heated up by a heated impression cylinder, most advantageously by the impression cylinder of the last printing or varnishing unit upstream of the dryer device as viewed in the direction of sheet travel. Direct contact between the impression cylinder and the sheet ensures a highly effective temperature transfer. In addition, the sheet does not have time to lose the acquired temperature again before entering the dryer.

In accordance with an added mode of the invention, it is particularly advantageous to use the waste heat of the dryer to preheat the sheet with the aid of the impression cylinder since the temperature of the waste heat of hot-air dryers generally ranges between about 50° C. and 80° C. (approximately between 122° F. and 176° F.) and can be used directly, i.e. without the use of additional heat pumps, to heat the impression cylinder.

In accordance with an additional mode of the invention, in order to stabilize the printing process, it may furthermore be advantageous to heat up or warm up further cylinders in the path of sheet travel in addition to the impression cylinder in the last printing unit upstream of the dryer device. An especially advantageous feature is to heat up the sheets to a temperature of 25° C. (approximately 77° F.) as early as on the feed table, to even out temperature fluctuations of the feeder stacks that are being supplied. The temperature of the additional cylinders and/or of the feed table may also be increased by using the waste heat of the dryer device.

With the objects of the invention in view, there is also provided a sheet-fed printing press, comprising a dryer device for thermally drying a layer of ink and/or varnish printed onto sheets, and a plurality of printing and/or varnishing units including a last printing or varnishing unit disposed upstream of the dryer device in sheet travel direction. The last printing or varnishing unit has a heatable impression cylinder with an operating temperature selected in such a way that the sheets leaving the impression cylinder have been heated to a temperature higher than the ambient temperature as the sheets enter the dryer device.

Other features which are considered as characteristic for the invention are set forth in the appended claims.

Although the invention is illustrated and described herein as embodied in a printing press and a method of drying printed or varnished sheets in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
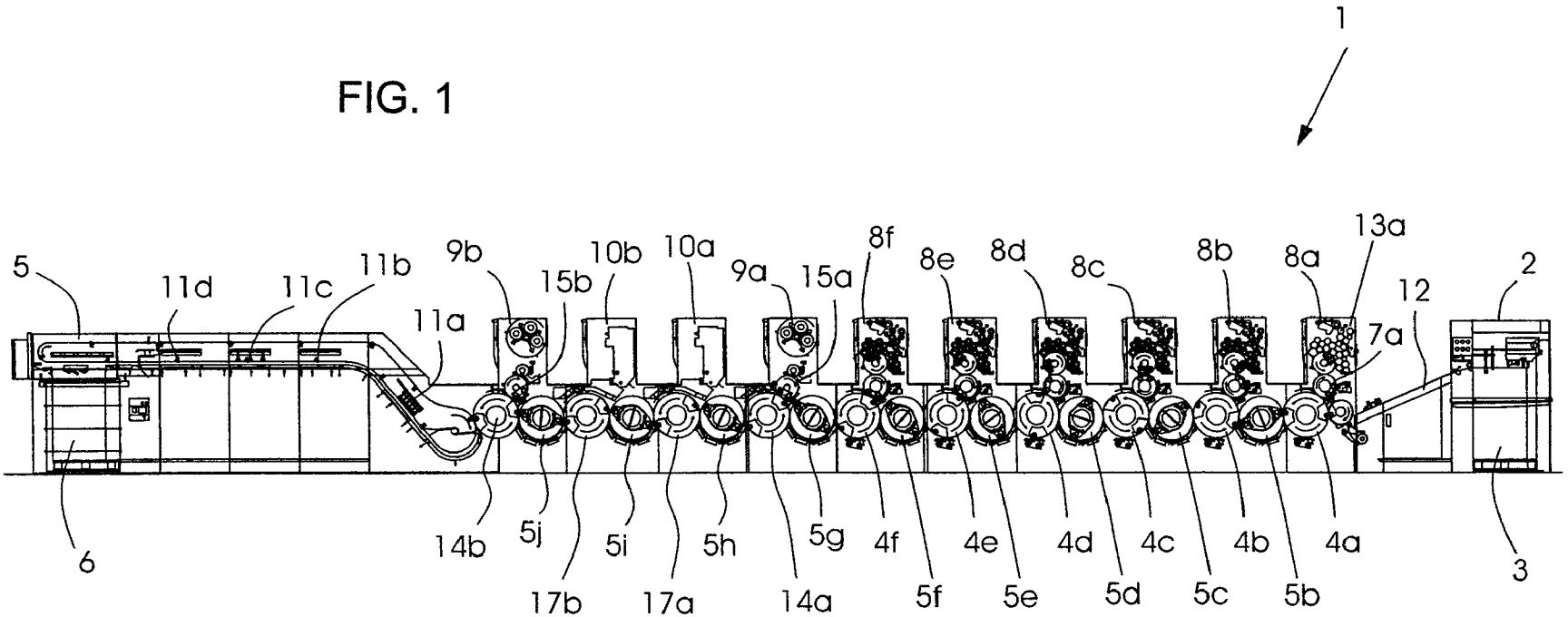
FIG. 1 is a diagrammatic, longitudinal-sectional view of a conventional sheet-fed printing press with a plurality of printing and varnishing units and a dryer device including a drying tower and an extended delivery.

Referring now to the figures of the drawings in detail and first, particularly, to FIG. 1 thereof, there is seen a straight-printing sheet-fed offset printing press 1 of in-line construction, i.e. a printing press for printing on only one side of the sheets. The printing press 1 includes a feeder 2 with a stack 3 of unprinted paper sheets disposed therein and six printing units 8*a* to 8*f* for the four process colors and for two optional special or spot colors, a first varnishing unit 9*a*, followed by two drying towers 10*a* and 10*b*, a second varnishing unit 9*b*, and a delivery 5 for a sheet stack 6. In the region of chain guides of the delivery 5, four further interdeck dryers 11*a* to 11*d* are inserted between the chain guides in the delivery that has been extended in a corresponding way.

Reference numerals 4*a* to 4*f* designate impression cylinders of the printing units, reference numerals 14*a* and 14*b* those of the varnishing units, and reference numerals 17*a* and 17*b* those of the drying towers. In cooperation with the impression cylinders, transfer drums 5*b* to 5*f* provided between the printing units, transfer drums 5*g* and 5*j* provided upstream of the varnishing units 9*a* and 9*b*, and transfer drums 5*h* and 5*i* provided upstream of the drying towers, convey the printed sheets through the press.

The drying towers 10*a* and 10*b* are combined hot-air dryer and infrared radiator units for drying aqueous dispersion varnish applied in the varnishing unit 9*a* before the second varnishing unit 9*b* applies a second layer of varnish onto the dried first layer of varnish. Each of the two drying towers 10*a* and 10*b* has an electrical connection power of 60 kW.

The interdeck dryers 11*a* to 11*d* are likewise constructed as combined infrared radiation/hot-air dryers. They are available from Heidelberger Druckmaschinen AG under the trademark "DryStar 3000" and have a maximum electrical connection power of 66 kW per inserted unit.

A printing press of this type is available, for example, from Heidelberger Druckmaschinen AG under the trademark "Speedmaster XL 105-6-LYYLX3" for the 75×105 cm format. The press has a total length of 21 m. The dryer section requires 5.3 m of this total length for the drying towers 10*a* and 10*b* and the interdeck dryers 11*b* to 11*d* in the extended delivery.

Figure 2:
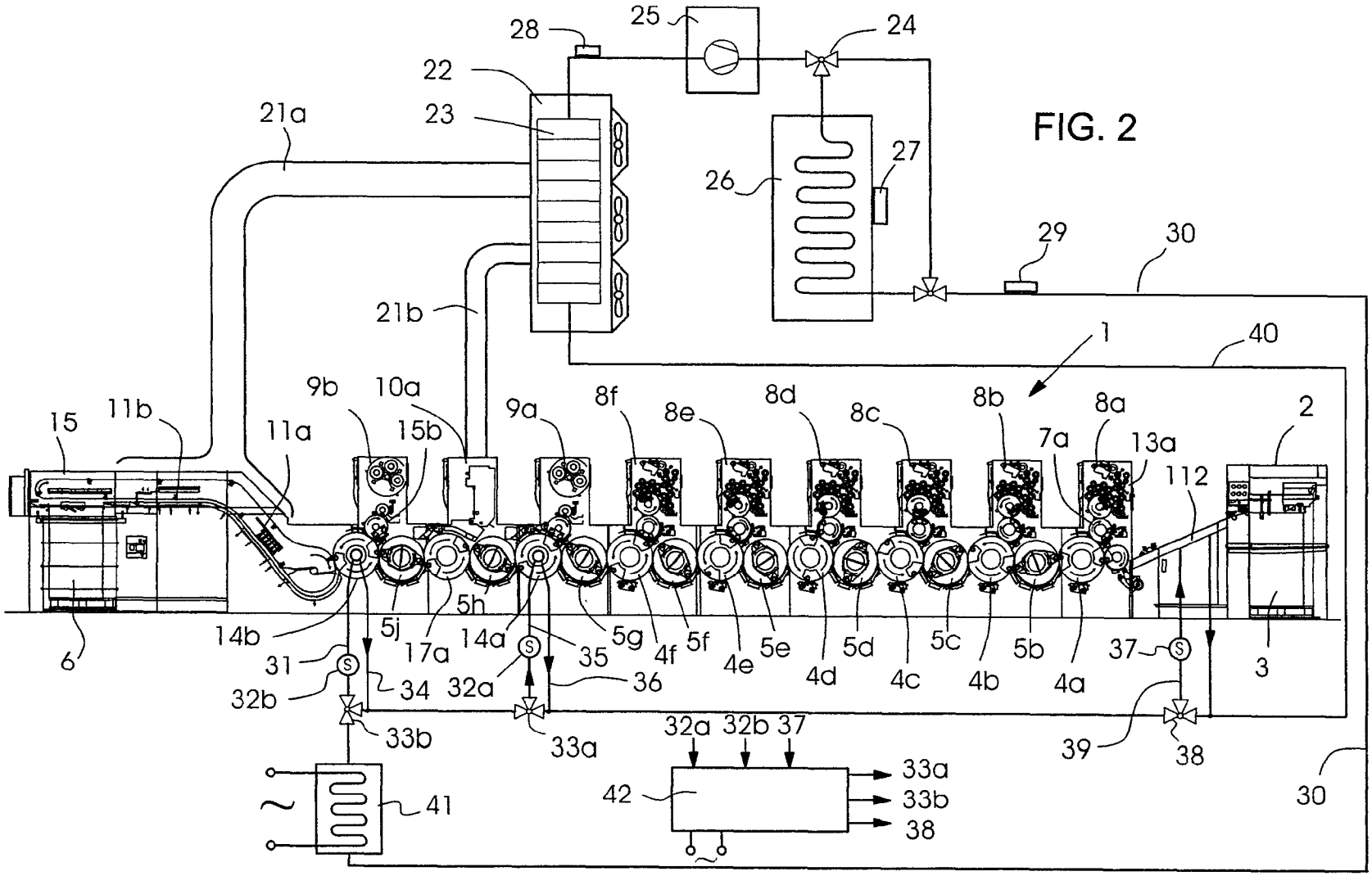
FIG. 2 is a view of the printing press of FIG. 1 modified in accordance with the invention.

FIG. 2 shows this press in an embodiment that has been modified in accordance with the invention. The drying tower 10*b* has been eliminated, and the extended delivery including the four interdeck dryers 11*a* to 11*d* has been replaced by a shortened delivery 15. The length of the dryer section has been cut in half since it only uses two interdeck dryers 11*a* and 11*b*. Otherwise, machine parts that are identical with those shown in FIG. 1 are identified by identical reference numerals and will not be explained in detail again.

The exhaust air of the drying tower 10*a* and of the interdeck dryers 11*a* and 11*b* is fed to a cooler 22 through exhaust pipes 21*a* and 21*b*. In the cooler 22, the hot exhaust air, which has a temperature of about 70° C. (approximately 158° F.), heats up an infeed line 30 of a hot-water circuit or system through a heat exchanger 23. The circuit includes an infeed line pump 25, a motor-driven three-way valve 24 and a hot-water or heat reservoir 26. Temperature sensors 27 are provided on the heat reservoir 26, temperature sensors 28 are provided at an outlet of the cooler 22 and a temperature sensor 29 is provided in the infeed line 30 of the hot-water heating system. These temperature sensors 27, 28, 29 control the motor-driven three-way valve 24 in such a way that the unneeded surplus heat emitted by the cooler 22 heats up the heat reservoir 26, which feeds an increasing amount of warm water into the infeed line 30 in times when the heat supply is insufficient.

The hot-water circuit heats the impression cylinders 14*b* and 14*a* of the two varnishing units 9*b* and 9*a* and a table 112 of the sheet feeder 2.

The impression cylinder 14*b* of the varnishing unit 9*b* is supplied with hot water at an infeed line temperature of about 60° C. (approximately 140° F.) through a supply line 31. The temperature is monitored by a temperature sensor 32*b* and controlled in a closed loop through the use of a first mixing valve 33*b*. The water that returns from the impression cylinder 14*b* through a return line 34 has a lower temperature of about 50° C. (approximately 122° F.) and is fed through a second mixing valve 33*a* to an inlet 35 of the impression cylinder 14*a* of the first varnishing unit 9*a*. In this case, too, a sensor 32*a* is provided for measuring the feed temperature.

The impression cylinders 14*a* and 14*b* may be provided with a rotary feedthrough for the hot-water connection and a piping system disposed in the cylinder walls as is described, for example, in German Published, Non-Prosecuted Patent Application DE 10 2005 022 595 A1.

The water being fed back from the impression cylinder 14*a* through a return line 36 is fed through a third mixing valve 38 to an infeed line 39 for the heated sheet feed table 112, at a temperature of about 30° C. (approximately 86° F.). In this case, too, a sensor 37 measures the temperature in the supply line 39. A return connection of the feed table 112 leads to a return line 40 leading to the heat exchanger 23 in the cooler 22.

The mixing valves 33*a*, 33*b* and 38 are actuated by a control unit 42 in accordance with signals from the temperature sensors 32*a*, 32*b* and 37 to maintain temperatures T1 in the infeed line 31, T2 in the inlet or infeed line 35 and T3 in the infeed line 39 at the aforementioned levels of 60° C. (approximately 140° F.), 50° C. (approximately 122° F.), and 30° C. (approximately 86° F.), respectively. An additional heater 41, which is likewise connected to the control unit 42, is switched on by the control unit 42 in cases in which the temperature of the hot water supplied by the cooler 22 or by the hot-water reservoir 26 is not sufficient, for example when a print job is started and the hot-water reservoir is cold.

The device operates as follows: When the sheets transported through the printing press by the transfer drums 5*b* to 5*g* and by the impression cylinders 4*a* to 4*f* in the printing units 8*a* to 8*f* reach the varnishing unit 9*a*, the sheets have a temperature of about 25° C. to 30° C. (approximately 77° F. to 86° F.). What is taken into account herein is the fact that the printing units approximately assume this temperature due to the waste heat generated in the printing units. Thus, this temperature is the ambient temperature for the printed sheets conveyed through the press. In order to maintain this temperature right from the start in view of a stable printing process, the feed table 112 is heated by water of a temperature of approximately 30° C. (approximately 86° F.). Consequently, the sheets that are taken off the paper stack in the feeder 2 have the desired temperature of approximately 25° C. (approximately 77° F.) when they reach the first printing unit 8*a* and can be printed at this temperature even if the stacks that are supplied to the feeder 2 are cold.

The sheets that have been printed on and provided with a first layer of varnish are heated up to a temperature of about 37° C. (approximately 99° F.) by contacting the impression cylinder 14*a* in the first varnishing unit 9*a*. This temperature of 37° C. (99° F.) corresponds to the persistence temperature which the paper sheets would have been heated up to after passing through the two drying towers 10*a* and 10*b* of the press shown in FIG. 1 if they had entered the first drying tower 10*a* at the ambient temperature of about 25° C. (approximately 77° F.). For a paper sheet of a grammage of 135 g/m$^2$ in the 75×105 format, heating up the sheet from the rear side through the use of the impression cylinder 14*a* by about 12° C. corresponds to an energy input of about 1.66 kJ. At a press speed of 18,000 sheets per hour, i.e. 5 sheets per second, this is equivalent to an electric wattage of 8.3 kW if we assume that the drying towers have an efficiency factor of $\eta=1$. However, this is not the case with IR radiators, for example. They have an efficiency factor of about 25%.

Thus, the second drying tower 10*b* can be dispensed with.

Once the sheets have passed the drying tower 10*a*, they are varnished once more in the second varnishing unit 9*b*, where they are contacted by the impression cylinder 14*b* having a temperature of 60° C. (approximately 140° F.). They reach the impression cylinder 14*b* at a temperature of about 37° C. (approximately 99° F.) and are heated up by about 7° C. (12° F.) to a temperature of 44° C. (approximately 111° F.). This ensures that the wetness of the second layer of varnish begins to evaporate virtually immediately as the sheets enter a first module or interdeck dryer 11*a* of the dryer unit formed by two modules or interdeck dryers 11*a* and 11*b* in the delivery 15. The interdeck dryers 11*c* and 11*d* additionally provided in the press shown in FIG. 1 can be dispensed with because the measures described herein ensure that a drying section shortened almost by half is sufficient. However, the sheets may also be delivered at a temperature that is lower than the 44° C. (approximately 111° F.) entry temperature (stack temperature) if the delivery dryers dry mainly convectively (i.e. exclusively by hot air) and the temperature of the hot air is selected in such a way that a persistence temperature of less than the aforementioned temperature of 44° C. (approximately 111° F.) is achieved.

Figure 3:
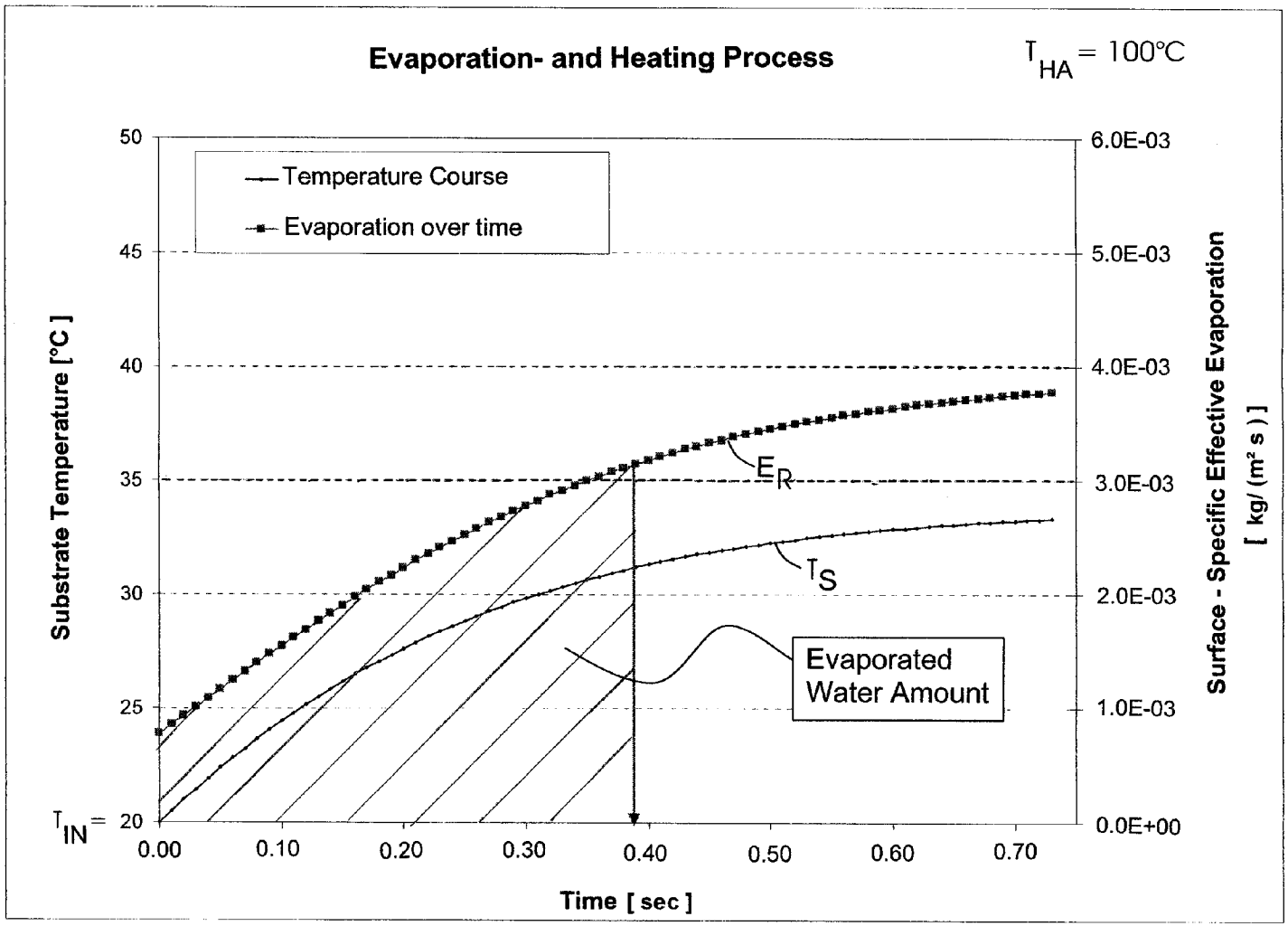
FIGS. 3 and 4 are diagrams illustrating a degasification behavior of wetness from a varnished printed sheet as the sheet passes through the dryer.
Figure 4:
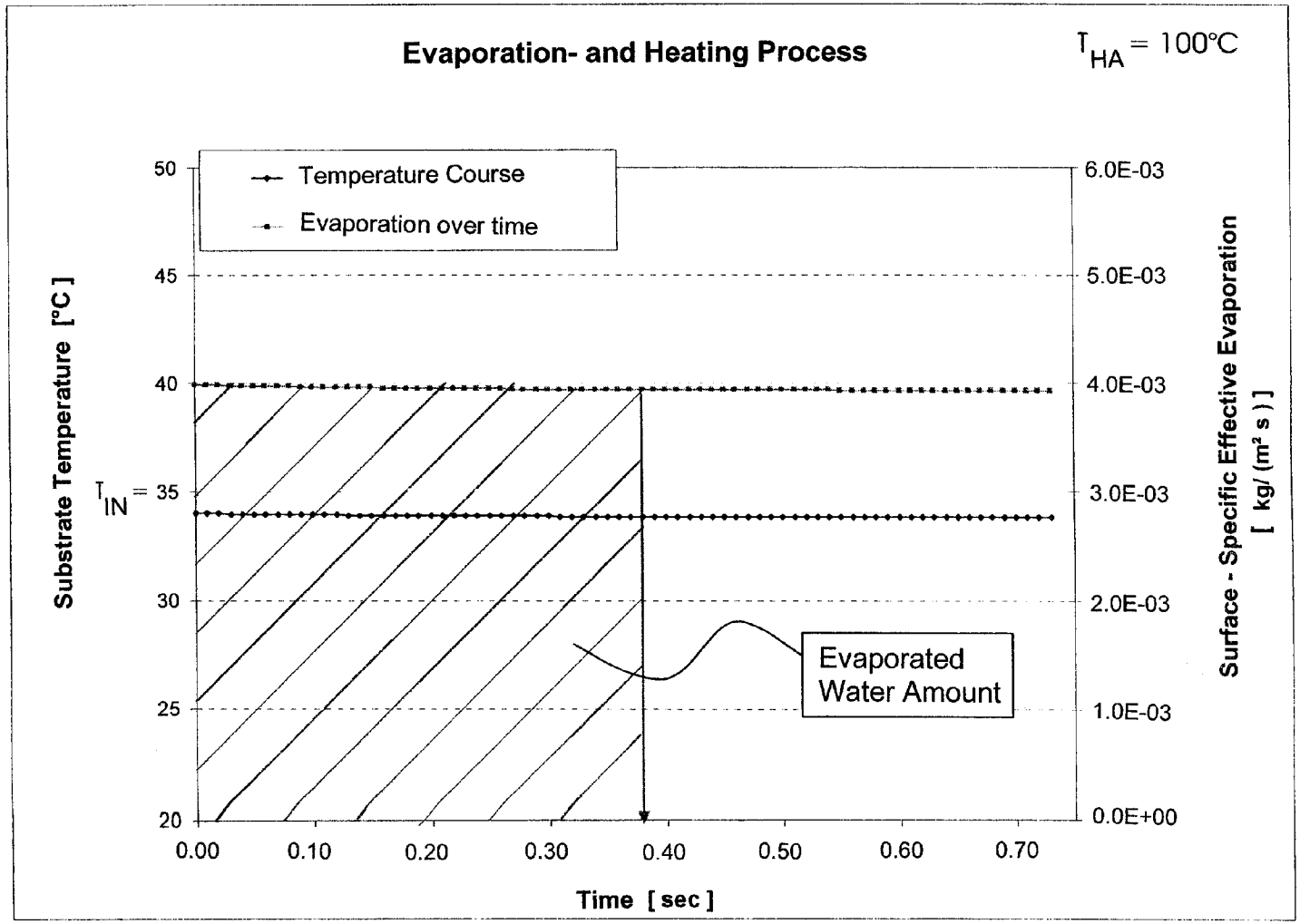

The effect attained by the invention will best be understood with reference to the diagrams shown in FIGS. 3 and 4. FIG. 3 shows the temperature increase Ts of a varnished sheet in a hot-air dryer having a temperature THA Of 100° C. (approximately 212° F.), assuming that the sheet enters the dryer at a temperature of 20° C. (approximately 68° F.). After 0.4 sec, which is the amount of time a sheet needs to pass through a typical 1.6 m drying section at a printing speed of 15,000 sheets per hour, the temperature of the sheet has increased to 32° C. (approximately 90° F.), i.e. by about 12° C. (about 22° F.). The diagram also shows the evaporation of the wetness from the layer of varnish as a function of time. The evaporation rate strongly depends on the temperature of the sheet, i.e. of the paper substrate. It converges at approximately 4 g/m$^2$sec at an assumed sheet temperature of 34° C. (approximately 93° F.). However, this temperature is never reached fully because at this point in time the sheet has long since left the dryer. The amount of evaporated water corresponds to the shaded area below the evaporation rate identified by reference symbol ER.

In contrast, FIG. 4 illustrates a case wherein the sheet has already reached a temperature of 34° C. (93° F.) when it enters the dryer. In this case, an evaporation rate of 4 g/m$^2$sec is achieved right from the start and the amount of water expelled or evaporated in the dryer is almost twice as high.

The present invention has been described with reference to an exemplary embodiment referring to a straight-printing press with two varnishing units. However, it may likewise be used in presses with just one varnishing unit or in perfecting presses, for example in press configurations wherein a varnishing unit and a dryer unit are provided upstream of the reversing device or upstream of the first printing unit of the straight-printing portion of the press to keep the drying section at these locations short. Moreover, the invention can also be used in connection with sheet-fed printing presses without a varnishing unit to effectively dry conventional inks for wet-offset printing or the lower-viscosity anilox inks that are applied by short inking units including a screen roller and a chambered doctor blade. In this case, the sheets are preheated through the use of the impression cylinder of the last printing unit before they enter the dryer. This ensures that the evaporation of the solvent proportion of the anilox inks starts immediately after the sheets enter the dryer unit.

The invention claimed is:

1. A sheet-fed printing press, comprising:

a dryer device for thermally drying a layer of ink and/or varnish printed onto sheets;

a plurality of printing and/or varnishing units including a last varnishing unit disposed upstream of said dryer device in sheet travel direction;

said last varnishing unit having a heatable impression cylinder with an operating temperature selected to cause the sheets leaving the impression cylinder to have been heated to a temperature higher than ambient temperature as the sheets enter said dryer device.

2. The printing press according to claim 1, which further comprises further heatable cylinders in said printing and/or varnishing units other than said last printing or varnishing unit.

3. The printing press according to claim 1, which further comprises a heatable sheet feed table.

4. The printing press according to claim 1, which further comprises other sheet-guiding cylinders, said operating temperature of said heatable impression cylinder being higher than a temperature of said other sheet-guiding cylinders.

5. The printing press according to claim 4, wherein said operating temperature of said impression cylinder ranges between 40° C. and 80° C.

6. The printing press according to claim 4, wherein said operating temperature of said impression cylinder ranges between 45° C. and 65° C.

7. The printing press according to claim 1, wherein said dryer device is at least one device selected from the group consisting of a hot-air dryer and an infrared radiation dryer.

8. The printing press according to claim 1, which further comprises a heat exchanger receiving exhaust air from said dryer device and being connected to said heatable impression cylinder.

9. The printing press according to claim 8, which further comprises a fluid heated by said heat exchanger and flowing through said heatable impression cylinder.

10. A sheet-fed printing press, comprising:

a dryer device for thermally drying a layer of ink and/or varnish printed onto sheets;

a heat exchanger receiving exhaust air from said dryer device; and a plurality of printing and/or varnishing units including a last varnishing unit disposed upstream of said dryer device in sheet travel direction;

said last varnishing unit including a heatable impression cylinder receiving exhaust heat from said heat exchanger, said heatable impression cylinder having an operating temperature between 40° C. and 80° C. selected to cause the sheets leaving the impression cylinder to have been heated to a temperature higher than ambient temperature as the sheets enter said dryer device.

11. The printing press according to claim 10, which further comprises further heatable cylinders in said printing and/or varnishing units other than said last varnishing unit.

12. The printing press according to claim 10, which further comprises a heatable sheet feed table.

13. The printing press according to claim 10, which further comprises other sheet-guiding cylinders, said operating temperature of said heatable impression cylinder being higher than a temperature of said other sheet-guiding cylinders.

14. The printing press according to claim 10, wherein said operating temperature of said impression cylinder ranges between 45° C. and 65° C.

15. The printing press according to claim 10, wherein said dryer device is at least one device selected from the group consisting of a hot-air dryer and an infrared radiation dryer.

16. The printing press according to claim 10, which further comprises a fluid heated by said heat exchanger and flowing through said heatable impression cylinder.

* * * * *